US011448421B2

(12) United States Patent
Budelsky et al.

(10) Patent No.: US 11,448,421 B2
(45) Date of Patent: Sep. 20, 2022

(54) ACCESS DOOR ASSEMBLY FOR A VERTICAL AIR CONDITIONING UNIT

(71) Applicant: Haier US Appliance Solutions, Inc., Wilmington, DE (US)

(72) Inventors: Stephen Budelsky, Louisville, KY (US); Harold Moore, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 126 days.

(21) Appl. No.: 16/929,645

(22) Filed: Jul. 15, 2020

(65) Prior Publication Data

US 2022/0018572 A1 Jan. 20, 2022

(51) Int. Cl.
*F24F 13/20* (2006.01)
*F24F 1/022* (2019.01)

(52) U.S. Cl.
CPC ..... *F24F 13/20* (2013.01); *F24F 1/022* (2013.01)

(58) Field of Classification Search
CPC ..... F24F 13/20; F24F 1/58; F24F 2221/32; F24F 1/56; F24F 1/022; E05D 15/00; E05D 15/502; E05D 15/507
USPC ..... 49/192, 193
See application file for complete search history.

(56) References Cited

U.S. PATENT DOCUMENTS 4,424,607 A 1/1984 Langenhorst
2005/0170772 A1* 8/2005 De Domenico ..... F24F 13/085 454/195

FOREIGN PATENT DOCUMENTS

KR 100780788 B1 11/2007
KR 20080006121 A 1/2008

* cited by examiner

*Primary Examiner* — Cassey D Bauer
(74) *Attorney, Agent, or Firm* — Dority & Manning, P.A.

(57) ABSTRACT

An air conditioning appliance defining a vertical direction includes a housing comprising a wall disposed in the vertical direction, the wall defining an opening therethrough; a heat exchanger disposed in the housing; a compressor in fluid communication with the heat exchanger to circulate a refrigerant through the heat exchanger; and a door assembly attached to the wall proximal to the opening. The door assembly includes a frame removably secured to the wall and surrounding the opening, the frame comprising a tab protruding from a first surface of the frame and extending in the vertical direction, and a door pivotably connected to the frame, the door defining an aperture into which the tab is received. The tab is symmetrical about a horizontal centerline of the tab.

18 Claims, 6 Drawing Sheets

ACCESS DOOR ASSEMBLY FOR A VERTICAL AIR CONDITIONING UNIT

FIELD OF THE INVENTION

The present subject matter relates generally to air conditioning units, and more particularly to access doors for vertical air conditioning units.

BACKGROUND OF THE INVENTION

Air conditioners or air conditioner units are conventionally utilized to adjust the temperature within structures such as dwellings and office buildings. In particular, one-unit type room air conditioner units, such as single package vertical units (SPVU), or package terminal air conditioners (PTAC) may be utilized to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit. One or more control boards are typically provided to direct the operation of various elements of the particular air conditioner unit.

Some conventional air conditioning units include an access door for allowing a technician to access the cooling system or other serviceable parts within the air conditioning unit. Typically, the access door is hinged on one side thereof so as to be rotatably connected to the air conditioning unit. These air conditioning units are produced having the access door hinged on only one side. Since these air conditioning units can be installed near corners or in tight spaces, intensive planning must take place before production to ensure the access door is hinged on the correct side to allow the access door to be opened without obstruction. In some cases, when conventional air conditioning units are mass produced with an access door hinged on one side, a significant amount of the air conditioning units may be unusable due to an opening direction of the access door.

As a result, an air conditioning unit that subjugates one or more of the above mentioned drawbacks would be useful, In particular, it would be useful to provide a reversible access door assembly capable of easily switching an opening direction of the access door.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an air conditioning unit is provided. The air conditioning unit may include a housing comprising a wall disposed in the vertical direction, the wall defining an opening therethrough, a heat exchanger disposed in the housing, a compressor in fluid communication with the heat exchanger to circulate a refrigerant through the heat exchanger, and a door assembly attached to the wall proximal to the opening. The door assembly may include a frame removably secured to the wall and surrounding the opening, the frame comprising a tab protruding from a first surface of the frame and extending in the vertical direction, and a door pivotably connected to the frame, the door defining an aperture into which the tab is received.

In another exemplary aspect of the present disclosure, a door assembly is disclosed. The door assembly may be used on an air condition unit. The door assembly may include a frame removably secured to the wall and surrounding the opening, the frame comprising a tab protruding from a first surface of the frame and extending in the vertical direction. The door assembly may further include a door pivotably connected to the frame and rotatable between an open position and a closed position with respect to the frame, the door defining an aperture into which the tab is received, wherein a top edge of the tab extends at a first predetermined angle with respect to the frame and a bottom edge of the tab extends at a second predetermined angle with respect to the frame, the first predetermined angle being equal and mirrored to the second predetermined angle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
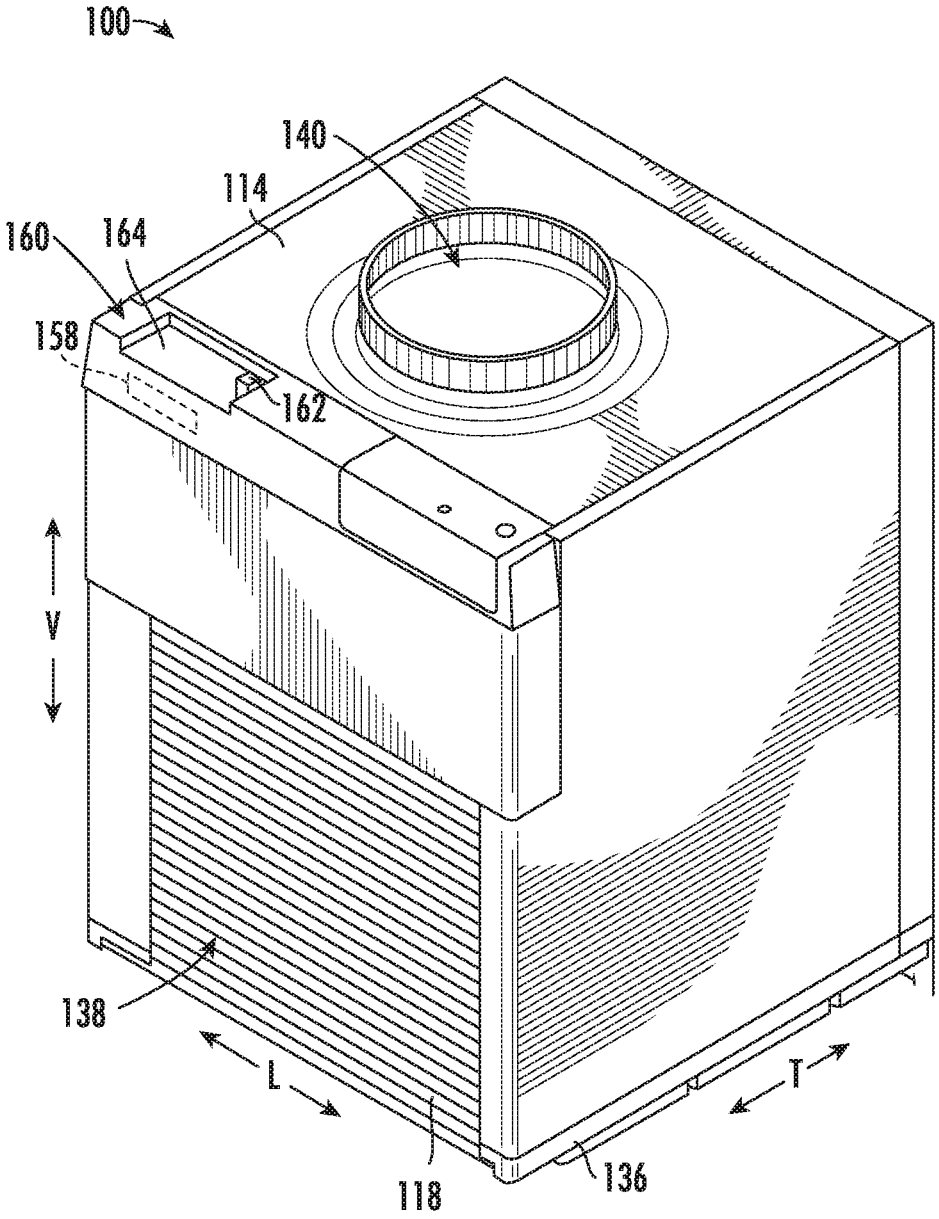
FIG. 1 provides a perspective view of an air conditioning appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
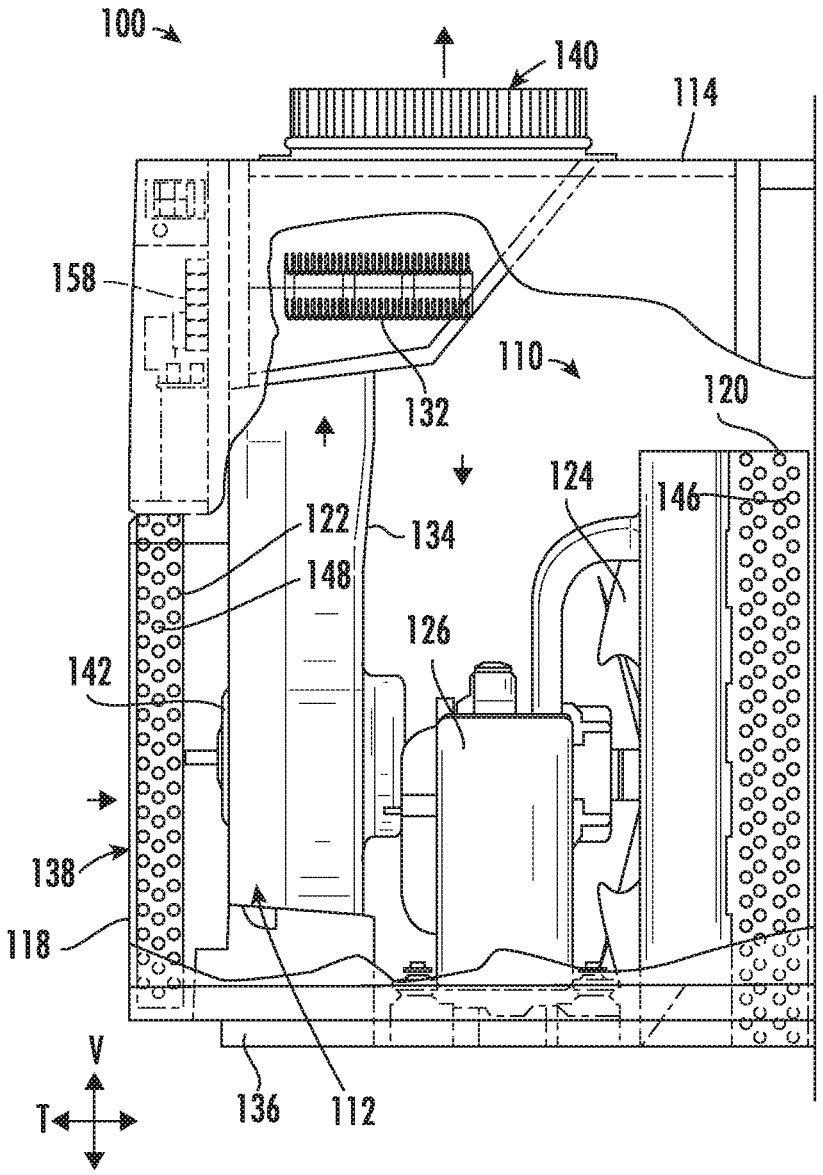
FIG. 2 provides a partially-transparent elevation view of the exemplary air conditioner unit of FIG. 1.

Turning now to the figures, FIGS. 1 and 2 illustrate an exemplary air conditioner appliance (e.g., air conditioner 100). As shown, air conditioner 100 may be provided as a one-unit type air conditioner 100, such as a single-package vertical unit. Air conditioner 100 includes a package housing 114 supporting an indoor portion 112 and an outdoor portion 110.

Generally, air conditioner 100 defines a vertical direction V, lateral direction L, and transverse direction T. Each direction V, L, T is perpendicular to each other, such that an orthogonal coordinate system is generally defined.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 is part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components of outdoor portion 110 are mounted on a basepan 136, as shown.

During certain operations, air may be drawn to outdoor portion 110 through rear opening 116. Specifically, an outdoor inlet 128 defined through housing 114 may receive outdoor air motivated by outdoor fan 124. Within housing 114, the received outdoor air may be motivated through or across outdoor fan 124. Moreover, at least a portion of the outdoor air may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable discrete orientation.

As shown, indoor portion 112 may include an indoor heat exchanger 122, a blower fan 142, and a heating unit 132. These components may, for example, be housed behind the front opening 118. A bulkhead 134 may generally support or house various other components or portions thereof of the indoor portion 112, such as the blower fan 142. Bulkhead 134 may generally separate and define the indoor portion 112 and outdoor portion 110 within housing 114. Additionally or alternatively, bulkhead 134 or indoor heat exchanger 122 may be mounted on basepan 136 (e.g., at a higher vertical position than outdoor heat exchanger 120), as shown.

During certain operations, air may be drawn to indoor portion 112 through front opening 118. Specifically, an indoor inlet 138 defined through housing 114 may receive indoor air motivated by blower fan 142. At least a portion of the indoor air may be motivated through or across indoor heat exchanger 122 (e.g., before passing to bulkhead 134). From blower fan 142, indoor air may be motivated (e.g., across heating unit 132) and returned to the indoor area of the room through an indoor outlet 140 defined through housing 114 (e.g., above indoor inlet 138 along the vertical direction V). Optionally, one or more conduits (not pictured) may be mounted on or downstream from indoor outlet 140 to further guide air from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on basepan 136) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

The operation of air conditioner 100 including compressor 126 (and thus the sealed system generally), blower fan 142, outdoor fan 124, heating unit 132, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Figure 3:
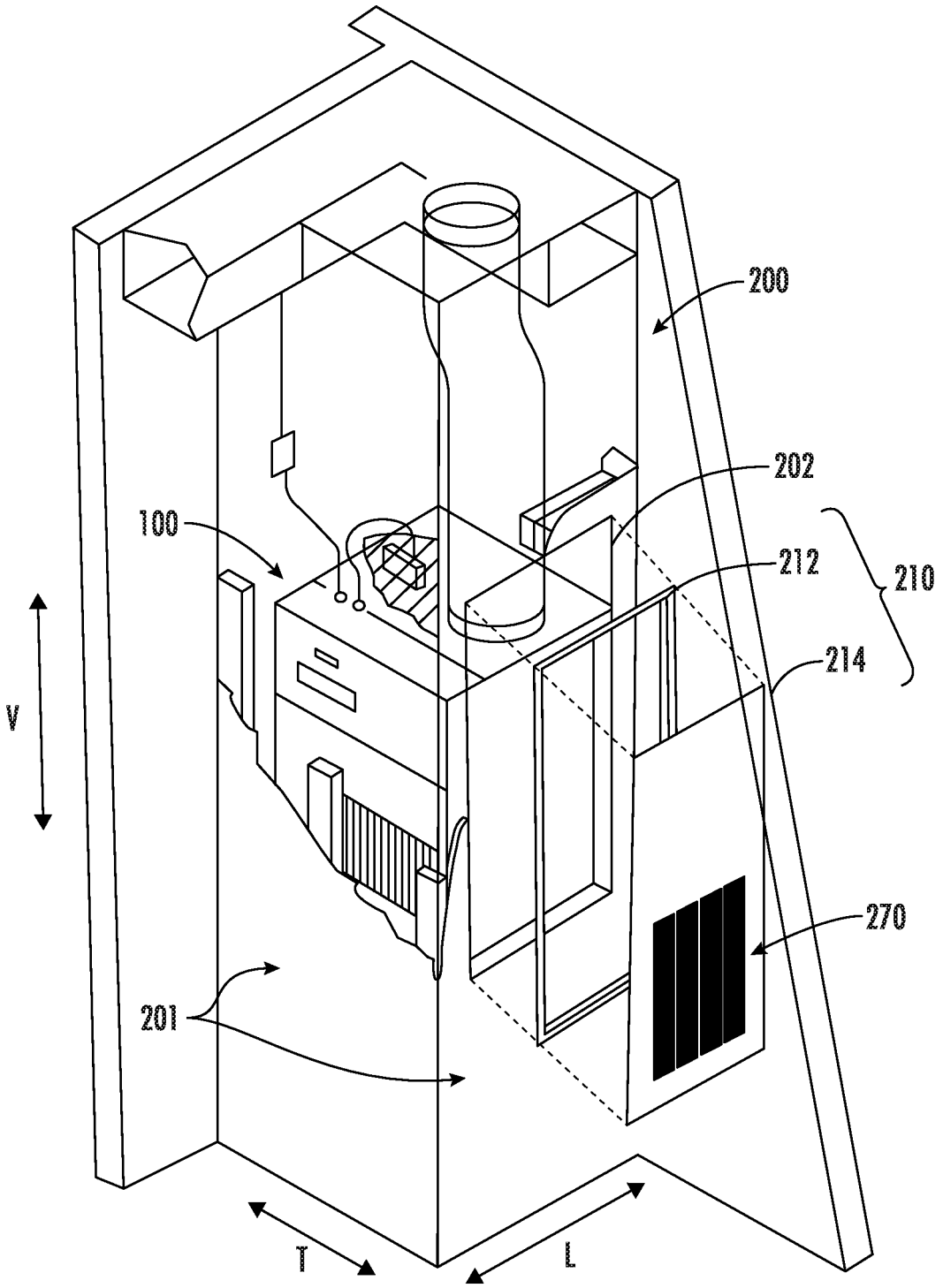
FIG. 3 provides a cut-away perspective view of a housing of the exemplary air conditioner unit of FIG. 1, with an access door and access door frame of an access door assembly detached.
Figure 4:
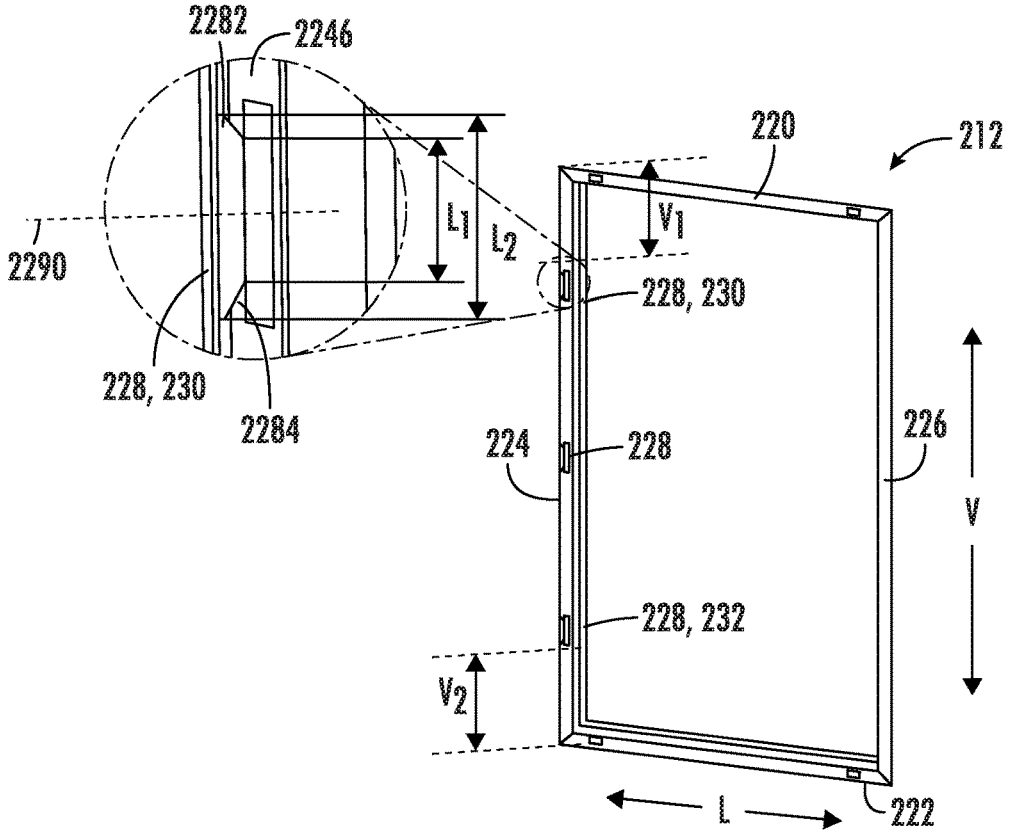
FIG. 4 provides a perspective view of the exemplary access door frame of FIG. 3.
Figure 5:
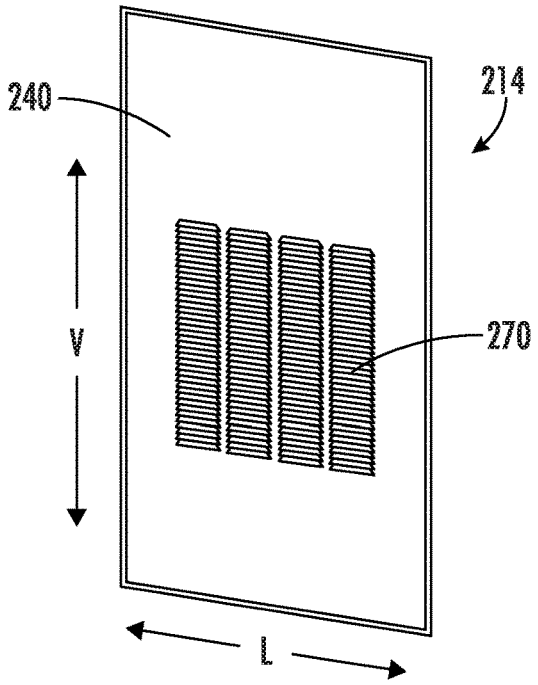
FIG. 5 provides a perspective view of the exemplary access door of FIG. 3.
Figure 6:
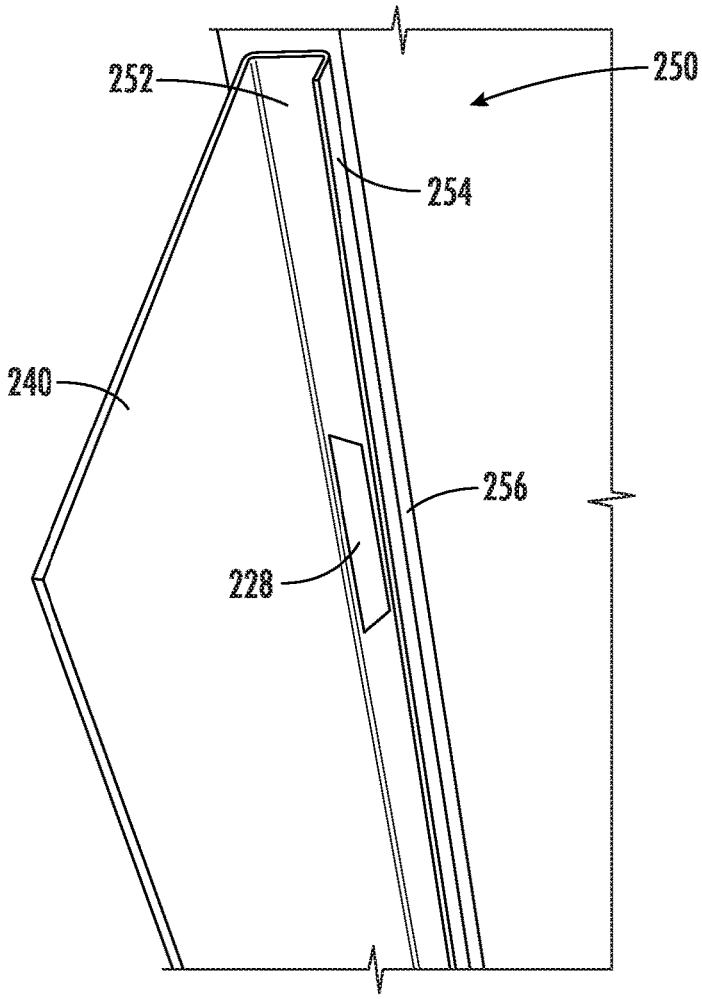
FIG. 6 provides a perspective view of a hinge of the exemplary access door of FIG. 3.
Figure 7:
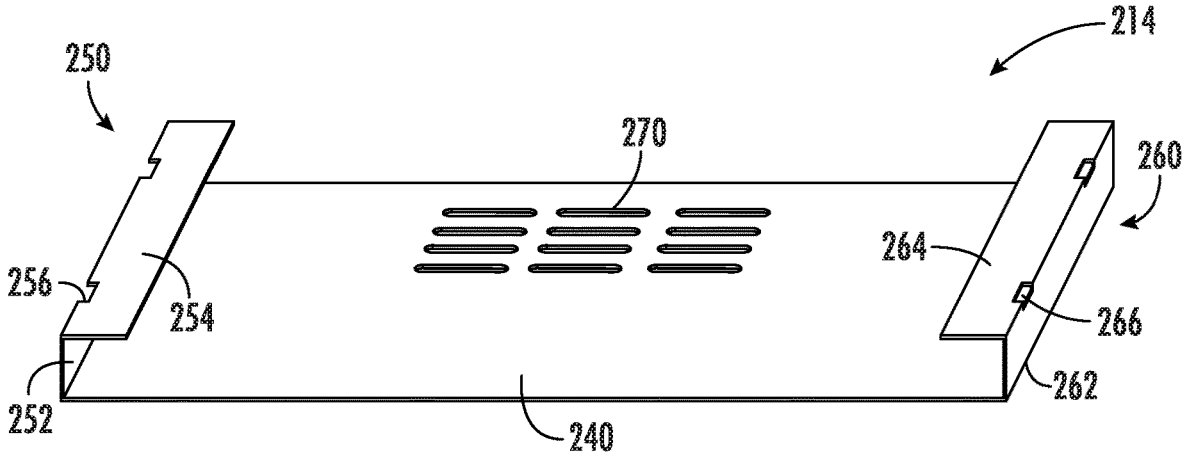
FIG. 7 provides a perspective view of the exemplary access door of FIG. 3.
Figure 8:
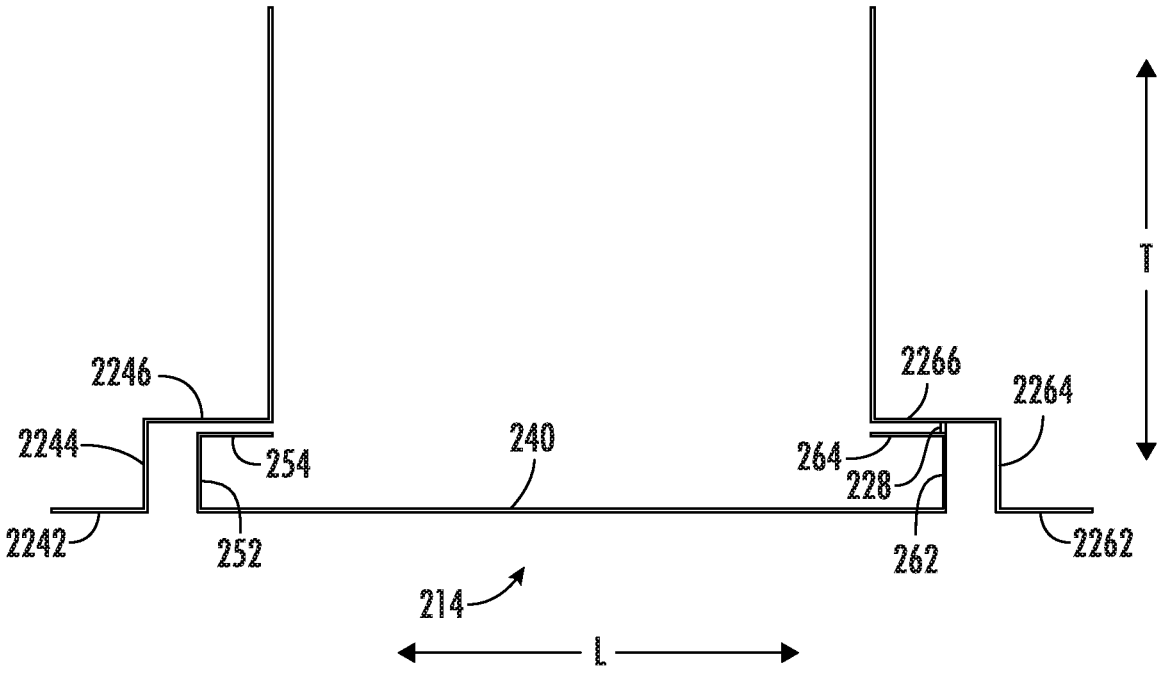
FIG. 8 provides an elevation view of the exemplary access door assembly of FIG. 3.

Referring now generally to FIGS. 3 through 8, FIG. 3 provides a cut-away perspective view of a housing of the exemplary air conditioner unit of FIG. 1, with an access door and access door frame of an access door assembly detached, FIG. 4 provides a perspective view of the exemplary access door frame of FIG. 3, FIG. 5 provides a perspective view of the exemplary access door of FIG. 3, FIG. 6 provides a perspective view of a hinge of the exemplary access door of FIG. 3, FIG. 7 provides a perspective view of the exemplary access door of FIG. 3, and FIG. 8 provides an elevation view of the exemplary access door assembly of FIG. 3.

As shown, a housing of the exemplary air conditioner unit 100 is shown. For instance, air conditioner 100 may be located within a housing 200. Housing 200 may be a stand-alone structure in which air conditioner 100 is contained. Additionally or alternatively, housing 200 may be provided within a building (e.g., a house, an office, or an apartment building). Housing 200 may include one or more walls 201. As shown, one or more of the walls 201 may extend in the vertical direction V and the transverse direction T or the lateral direction L. A service opening or access opening (e.g., service opening 202) may further be defined in one of the walls 201. For example, service opening 202 may be generally rectangular in shape. As will be described in detail below, a door assembly 210 may be removably attached to the wall 201. When connected, the door assembly 210 may surround the service opening 202 and provide selectable access to the air conditioner 100. Door assembly 210 may include a door frame 212 and an access door 214. A shape of door frame 212 may correspond to a shape of service opening 202.

The door frame 212 may include a plurality of members or rails. In one embodiment, the plurality of rails includes a top rail 220 extending substantially in the lateral direction L, a bottom rail 222 parallel to the top rail 220 and extending substantially in the lateral direction L, a first side rail 224 connecting the top rail 220 to the bottom rail 222 and extending substantially in the vertical direction V, and a second side rail 226 connecting the top rail 220 to the bottom rail 222 and extending substantially in the vertical direction V, the second side rail 226 being parallel to the first side rail 224. The top rail 220 and the bottom rail 222 may have equal lengths in the lateral direction L. The first side rail 224 and the second side rail 226 may have equal lengths in the vertical direction V.

The first side rail 224 may include a first extension 2242, a second extension 2244, and a third extension 2246. The first extension 2242, second extension 2244, and third extension 2246 may be individual panels that collectively form the first side rail 224. The first extension 2242 and the third extension 2246 may be parallel to each other. In other words, the first extension 2242 and the third extension 2246 may extend in the same direction from a planar portion of the first side rail 224 in the transverse direction T. In one example, the first extension 2242 and the third extension 2246 extend in the vertical direction V and the lateral direction L. The second extension 2244 may be perpendicular to the first extension 2242 and the third extension 2246. For instance, the second extension 2246 may coincide with the planar portion of the first side rail 224. The second extension 2244 may connect the first extension 2242 to the third extension 2246. A rear face of the first extension 2242 may be in surface contact with a front surface of the wall 201 that defines the opening 202. In other words, when the door frame 212 is attached to the wall 201, the rear face of the first extension 2242 may abut an outer surface of the wall 201. An outer face of the second extension 2244 may be in surface contact with a peripheral edge of the opening 202. In other words, when the door frame 212 is attached to the wall 201, the outer face of the second extension 2244 (e.g., facing outward from the door frame 212) may abut the peripheral edge of the opening 202 (e.g., facing inward toward the opening 202).

The second side rail 226 may include a first extension 2262, a second extension 2264, and a third extension 2266. The first extension 2262, second extension 2264, and third extension 2266 may be individual panels that collectively form the second side rail 226. The first extension 2262 and the third extension 2266 may be parallel to each other. In other words, the first extension 2262 and the third extension 2266 may extend in the same direction. In one example, the first extension 2262 and the third extension 2266 extend in the vertical direction V and the lateral direction L. The second extension 2264 may be perpendicular to the first extension 2262 and the third extension 2266. The second extension 2264 may connect the first extension 2262 to the third extension 2266. A rear face of the first extension 2262 may be in surface contact with a front surface of the wall 201 that defines the opening 202. In other words, when the door frame 212 is attached to the wall 201, the rear face of the first extension 2242 may abut an outer surface of the wall 201. An outer face of the second extension 2264 may be in surface contact with a peripheral edge of the opening 202. In other words, when the door frame 212 is attached to the wall 201, the outer face of the second extension 2244 (e.g., facing outward from the door frame 212) may abut the peripheral edge of the opening 202 (e.g., facing inward toward the opening 202).

The top rail 220 may include a first extension, a second extension, and a third extension (e.g., similar to the first side rail 224 or second side rail 226). The first extension, second extension, and third extension of the top rail 220 may be individual panels that collectively form the top rail 220. The first extension and the third extension may be parallel to each other. In other words, the first extension and the third extension may extend in the same direction. In one example, the first extension and the third extension extend in the vertical direction V and the lateral direction L. The second extension may be perpendicular to the first extension and the third extension. The second extension may connect the first extension to the third extension. A rear face of the first extension may be in surface contact with a front surface of the wall 201 that defines the opening 202. In other words, when the door frame 212 is attached to the wall 201, the rear face of the first extension may abut an outer surface of the wall 201. An outer face of the second extension may be in surface contact with a peripheral edge of the opening 202. In other words, when the door frame 212 is attached to the wall 201, the outer face of the second extension (e.g., facing outward from the door frame 212) may abut the peripheral edge of the opening 202 (e.g., facing inward toward the opening 202).

The bottom rail 222 may include a first extension, a second extension, and a third extension (e.g., similar to the first side rail 224 or second side rail 226). The first extension, second extension, and third extension of the bottom rail 222 may be individual panels that collectively form the bottom rail 222. The first extension and the third extension may be parallel to each other. In other words, the first extension and the third extension may extend in the same direction. In one example, the first extension and the third extension extend in the vertical direction V and the lateral direction L. The second extension may be perpendicular to the first extension and the third extension. The second extension may connect the first extension to the third extension. A rear face of the first extension may be in surface contact with a front surface of the wall 201 that defines the opening 202. In other words, when the door frame 212 is attached to the wall 201, the rear face of the first extension may abut an outer surface of the wall 201. An outer face of the second extension may be in surface contact with a peripheral edge of the opening 202. In other words, when the door frame 212 is attached to the wall 201, the outer face of the second extension (e.g., facing outward from the door frame 212) may abut the peripheral edge of the opening 202 (e.g., facing inward toward the opening 202).

First side rail 224, second side rail 226, top rail 220, and bottom rail 222 may be attached to each other to form the door frame 212. Any suitable attachment means may be used to attach the rails to each other. In some embodiments, the rails may be integrally formed (e.g., as one piece). Accordingly, door frame 212 may be fitted to opening 202 when assembled. Door frame 212 may then be removably attached to wall 201. Door frame 212 may be removably attached to wall 201 using any suitable method. In some embodiments, door frame 212 is screwed to wall 201. For example, screws or bolts are inserted through one or more of the top rail 220, bottom rail 222, first side rail 224, and second side rail 226. As such, door frame 212 may be detached from wall 201 and rotated 180 degrees about the transverse direction T and reattached to wall 201.

First side rail 224 may include one or more tabs 228. The tabs 228 may be provided in plurality, and may include three tabs, for example. It is understood that any suitable number of tabs may be provided according to specific embodiments. In certain embodiments, at least one tab 228 is formed on the third extension 2246. For instance, the tab 228 may protrude in the transverse direction T (e.g., in a normal direction of the wall 201) directly from the third extension 2246. The tab 228 may be perpendicular to the third extension 2246. In some embodiments, the tab 228 projects at a predetermined angle with respect to the third extension 2246 (i.e., at a predetermined non-parallel or non-perpendicular angle with respect to the transverse direction T). For example, the tab 228 may be angled toward a center of the opening 202. The tab 228 may be integral with the third extension 2246. For example, the tab 228 may be formed by cutting a portion of the third extension 2246 and bending the cut portion with respect to the third extension 2246. Additionally or alternatively, the tab 228 may be a separate piece that is joined to the third extension 2246 (e.g., via an adhesive, weld, solder, etc.). The tab 228 may extend in the vertical direction V. When a plurality of tabs 228 is formed, each of the tabs 228 may be aligned along the vertical direction V.

The tab 228 may include a top edge 2282 and a bottom edge 2284. The top edge 2282 may be angled with respect to the third extension 2246. For example, an angle less than 90° may be defined between the third extension 2246 and the top edge 2282 of the tab 228. In other words, the top edge 2282 may be angled upward from the front face of the third extension 2246. The bottom edge 2284 may also be angled with respect to the third extension 2246. For example, an angle less than 90° may be defined between the front face of the third extension 2246 and the bottom edge 2284 of the tab 228 is. In other words, the bottom edge 2284 may be angled downward from the front face of the third extension 2246. Optionally, the tab 228 may be symmetrical about a horizontal centerline 2290 of the tab 228. In other words, the top edge 2282 may be a reflection of the bottom edge 2284 (e.g., the dimensions of the top edge 2282 may be defined as equal and opposite to the dimensions of the bottom edge 2284). The tab 228 may define a first vertical edge 2286 and a second vertical edge 2288. The first vertical edge 2286 may be attached to and extend along the third extension 2246 of the first side rail 224 of the door frame 212. The second vertical edge 2288 may be opposite the first vertical edge 2286 (e.g., parallel to the first vertical edge 2286). The first vertical edge 2286 and the second vertical edge 2288 may be connected to each other by the top edge 2282 and the bottom edge 2284. In some embodiments, a vertical length $L_1$ of the first vertical edge 2286 is shorter than a vertical length $L_2$ of the second vertical edge 2288.

In an exemplary embodiment, two tabs 228 may be formed on door frame 212. The two tabs may include a first tab 230 and a second tab 232. The first tab may be located above the second tab along the third extension 2246 of the first side rail 224. The first tab 230 may be positioned a first vertical distance $V_1$ away from a top (e.g., uppermost surface) of the door frame 212. In other words, the first tab 230 may define a vertical gap (e.g., equal to the first vertical distance $V_1$) with the top of the door frame 212. The second tab 232 may be positioned a second vertical distance $V_2$ away from a bottom (e.g., bottommost surface) of the door frame 212. In other words, the second tab 232 may defined a vertical gap (e.g., equal to the second vertical distance $V_2$) with the bottom of the door frame 212. In some embodiments, the first vertical distance $V_1$ is equal to the second vertical distance $V_2$. In other words, a vertical distance between the top of the door frame 212 to the first tab 230 is equal to a vertical distance between the bottom of the door frame 212 and the second tab 232. As such, relative vertical positions of the first tab 230 and the second tab 232 may be advantageously identical whether the door frame 212 is attached to the wall 201 in a first position (e.g., tabs 228 on a first side) or a second position (e.g., tabs 228 on a second side).

As shown, the access door 214 may include a front panel 240, a first flange 250, and a second flange 260 opposite the first flange 250. The front panel 240 may define a main body of the door (e.g., the front panel 240 may cover the opening 202 in the wall 201). In other words, the front panel 240 may define a front face of the access door 214 (e.g., facing outward from the wall 201). The first flange 250 may be provided on a first side of the front panel 240 and the second flange 260 may be provided on a second side of the front panel 240. The first flange 250 may include a first transverse portion 252 and a first lateral portion 254. The first transverse portion 252 may be perpendicular to the front panel 240. The first transverse portion 252 may protrude rearward from the front panel 240 and may extend the length of the front panel 240 in the vertical direction V. The first lateral portion 254 may be parallel to the front panel 240 and perpendicular to the first transverse portion 252. The first lateral portion 254 may protrude inward (e.g., toward a center of front panel 240) from the first transverse portion 252 and may extend the length of the front panel 240 in the vertical direction V. In some embodiments, the first transverse portion 252 and the first lateral portion 254 are integral to the front panel 240. For instance, the first transverse portion 252 and the first lateral portion 254 may be bent from the front panel 240 (e.g., as roughly a C-shaped cross section in a horizontal plane defined in the lateral direction L and the transverse direction T).

The second flange 260 may include a second transverse portion 262 and a second lateral portion 264. The second transverse portion 262 may be perpendicular to the front panel 240. The second transverse portion 262 may protrude rearward from the front panel 240 and may extend the length of the front panel 240 in the vertical direction V. The second lateral portion 264 may be parallel to the front panel 240 and perpendicular to the second transverse portion 262. The second lateral portion 264 may protrude inward (e.g., toward a center of front panel 240) from the second transverse portion 262 and may extend the length of the front panel 240 in the vertical direction V. In some embodiments, the second transverse portion 262 and the second lateral portion 264 are integral to the front panel 240. For instance, the second transverse portion 262 and the second lateral portion 264 may be bent from the front panel 240 (e.g., as roughly a C-shaped cross section in the horizontal plane defined in the lateral direction L and the transverse direction T).

The first flange 250 may include a first aperture 256. The first aperture 256 may be formed at a junction of the first transverse portion 252 and the first lateral portion 254. The first aperture 256 may correspond and be complementary to the tab 228. In other words, the first aperture 256 may be formed to accept the tab 228 therein when the access door 214 is assembled to the door frame 212 in the first position. A plurality of first apertures 256 may be formed in the first flange 250. For instance, the number of first apertures 256 may correspond to the number of tabs 228 provided on the door frame 212 (e.g., two tabs 228, two first apertures 256).

The second flange 260 may include a second aperture 266. The second aperture 266 may be formed at a junction of the second transverse portion 262 and the second lateral portion 264. The second aperture 266 may correspond and be complementary to the tab 228. In other words, the second aperture 266 may be formed to accept the tab 228 therein when the access door 214 is assembled to the door frame 212 in the second position. A plurality of second apertures 266 may be formed in the second flange 260. For instance, the number of second apertures 266 may correspond to the number of tabs 228 provided on the door frame 212 (e.g., two tabs 228, two second apertures 266).

The access door 214 may include a plurality of louvres 270. The louvres 270 may be formed in the front panel 240 of the access door 214. The louvres 270 may allow air to circulate through the access door 214 and into the housing 200. In some embodiments, the louvres 270 are angled downward (e.g., openings in the front panel 240 are generally oriented downward). Any suitable number of louvres 270 may be provided in the access door 214 to allow a sufficient amount of air to pass into the housing 200.

Generally, the access door 214 may be assembled to the door frame 212 by inserting the tabs 228 into either the first apertures 256 or the second apertures 266. Because the top edge 2282 of the tab 228 is at an angle less than 90° with respect to the third extension 2246 of the first side edge 224 (e.g., when the door is installed in the first position), the access door 214 may be held against the door frame 212 by the weight of the access door 214.

When the access door 214 is assembled to the door frame 212 (e.g., in the first position), the first transverse portion 252 of the first flange 250 may be parallel to the second extension 2244 of the first side rail 224. A first gap may be formed between the first transverse portion 252 and the second extension 2244. Additionally or alternatively, the second transverse portion 262 of the second flange 260 may be parallel to the second extension 2264 of the second side rail 226. Additionally or alternatively, a second gap may be formed between the second transverse portion 262 and the second extension 2264. Accordingly, the access door 214 may be allowed to swing freely with respect to the door frame 212. Optionally, a user may be able to open the access door 214 by inserting one or more fingers into the second gap.

Advantageously, the door frame 212 may be installed in two positions (e.g., with the tabs 228 on a right side of the door frame 212 or with the tabs 228 on the left side of the door frame 212) and the access door 214 may be installed to open either to the left or to the right. Additionally or alternatively, the access door 214 may be installed to pivot about a right edge of the door frame 212 or a left edge of the door frame 212 while maintaining the air vent louvres 270 on the front panel 240 orientated in one direction (e.g., downward).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioning appliance defining a vertical direction, the air conditioning appliance comprising:

a housing comprising a wall disposed in the vertical direction, the wall defining an opening therethrough;

a heat exchanger disposed in the housing;

a compressor in fluid communication with the heat exchanger to circulate a refrigerant through the heat exchanger; and a door assembly attached to the wall proximal to the opening, the door assembly comprising a frame removably secured to the wall and surrounding the opening, the frame comprising a tab protruding from a first surface of the frame and extending in the vertical direction, and a door pivotably connected to the frame, the door defining an aperture into which the tab is received, wherein a length of a first edge of the tab that extends along the first surface of the frame is shorter than a length of a second edge of the tab opposite the first edge, and wherein the tab is symmetrical about a horizontal centerline of the tab.

2. The air conditioning appliance of claim 1, wherein the first surface of the frame is parallel to the wall, and wherein the tab protrudes in a normal direction from the first surface such that the tab is perpendicular to the first surface.

3. The air conditioning appliance of claim 2, wherein the tab is integral with the first surface.

4. The air conditioning appliance of claim 3, wherein the tab is a first tab, and wherein the frame further comprises a second tab spaced apart from the first tab along the first surface.

5. The air conditioning appliance of claim 4, wherein a vertical distance from a top of the frame to the first tab is equal to a vertical distance from a bottom of the frame to the second tab.

6. The air conditioning appliance of claim 4, wherein the aperture is a first aperture corresponding to the first tab, wherein the door further defines a second aperture spaced apart from the first aperture, and wherein the second aperture corresponds to the second tab.

7. The air conditioning appliance of claim 6, wherein the door comprises:

a first flange on a first side edge of the door, the first flange comprising a transverse portion and a lateral portion perpendicular to the transverse portion; and a second flange on a second side edge of the door, the second flange comprising a transverse portion and a lateral portion perpendicular to the transverse portion, wherein the first and second apertures are formed at the first side edge of the door, and wherein third and fourth apertures are formed at the second side edge of the door, the third and fourth apertures being symmetrical about a vertical center line of the door.

8. The air conditioning appliance of claim 7, wherein the first and second apertures are formed at a junction of the transverse portion and the lateral portion of the first side edge of the door, and wherein the third and fourth apertures are formed at a junction of the transverse portion and the lateral portion of the second side edge of the door.

9. The air conditioning appliance of claim 7, wherein the frame further comprises a second surface perpendicular to the first surface and protruding in the normal direction from the first surface, and wherein the first side edge of the door is spaced a predetermined distance from the second surface.

10. A door assembly of an air conditioning appliance comprising a wall and an opening formed in the wall, the door assembly comprising:

a frame removably secured to the wall and surrounding the opening, the frame comprising a tab protruding from a first surface of the frame and extending in the vertical direction, and a door pivotably connected to the frame and rotatable between an open position and a closed position with respect to the frame, the door defining an aperture into which the tab is received, wherein a top edge of the tab extends at a first predetermined angle with respect to the frame and a bottom edge of the tab extends at a second predetermined angle with respect to the frame, the first predetermined angle being equal and mirrored to the second predetermined angle, wherein the tab is a first tab, and wherein the frame further comprises a second tab spaced apart from the first tab along the first surface.

11. The door assembly of claim 10, wherein a length of a first edge of the tab that extends along the first surface of the frame is shorter than a length of a second edge of the tab opposite the first edge, and wherein the tab is symmetrical about a horizontal centerline of the tab.

12. The door assembly of claim 10, wherein the first surface of the frame is parallel to the door when the door is in a closed position, and wherein the tab protrudes in a normal direction from the first surface such that the tab is perpendicular to the first surface.

13. The door assembly of claim 12, wherein the tab is integral with the first surface.

14. The door assembly of claim 10, wherein a vertical distance from a top of the frame to the first tab is equal to a vertical distance from a bottom of the frame to the second tab.

15. The door assembly of claim 10, wherein the aperture is a first aperture corresponding to the first tab, wherein the door further defines a second aperture spaced apart from the first aperture, and wherein second aperture corresponds to the second tab.

16. The door assembly of claim 15, further comprising:

a first flange on a first side edge of the door, the first flange comprising a transverse portion and a lateral portion perpendicular to the transverse portion; and a second flange on a second side edge of the door, the second flange comprising a transverse portion and a lateral portion perpendicular to the transverse portion, wherein the first and second apertures are formed at the first side edge of the door, and wherein third and fourth apertures are formed at the second side edge of the door, the third and fourth apertures being symmetrical about a vertical center line of the door.

17. The door assembly of claim 16, wherein the first and second apertures are formed at a junction of the transverse portion and the lateral portion of the first side edge of the door, and wherein the third and fourth apertures are formed at a junction of the transverse portion and the lateral portion of the second side edge of the door.

18. The door assembly of claim 16, wherein the frame further comprises a second surface perpendicular to the first surface and protruding in the normal direction from the first surface, and wherein the first side edge of the door is spaced a predetermined distance from the second surface.

* * * * *